US007921518B2

(12) United States Patent
Saeger et al.

(10) Patent No.: US 7,921,518 B2
(45) Date of Patent: Apr. 12, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Thomas Schmitz, Mönchengladbach (DE); Johannes Bossmann, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 364 days.

(21) Appl. No.: 12/147,921

(22) Filed: Jun. 27, 2008

(65) Prior Publication Data

US 2009/0000064 A1 Jan. 1, 2009

(30) Foreign Application Priority Data

Jun. 29, 2007 (DE) ..... 10 2007 030 471
Jun. 29, 2007 (DE) ..... 20 2007 010 686 U
Mar. 14, 2008 (DE) ..... 10 2008 014 174

(51) Int. Cl.
*D01G 19/00* (2006.01)

(52) U.S. Cl. ..... 19/233

(58) Field of Classification Search ..... 19/155 R, 19/233

See application file for complete search history.

(56) References Cited

U.S. PATENT DOCUMENTS 1,408,780 A 3/1922 Schleifer
1,425,059 A 8/1922 Schleifer
1,694,432 A 12/1928 Schleifer
1,708,032 A 4/1929 Schleifer
1,715,473 A 6/1929 Schleifer
1,799,066 A 3/1931 Schleifer
2,044,460 A 6/1936 Bowerbank et al.
2,962,772 A 12/1960 Draving et al.
3,108,333 A 10/1963 Schleifer
4,270,245 A 6/1981 Stewart et al.
5,007,623 A 4/1991 Unkuri et al.

(Continued)

FOREIGN PATENT DOCUMENTS

DE 367482 C 1/1923

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for the fibre-sorting or fibre-selection of a fibre bundle comprising textile fibres, especially for combing, which is supplied to a fibre-sorting device, especially a combing device, having clamping devices which clamp the fibre bundle at a distance from its free end, which is combed to remove non-clamped constituents, the clamping devices each comprise two clamping jaws. To increase productivity and to enable an improved combed sliver to be obtained, downstream of the supply device there are arranged at least two rotatably mounted rollers rotating rapidly without interruption, the clamping devices being spaced apart in the region of the periphery of the rollers, and each clamping device comprising at least one nipper part which is at least partially resilient. The clamping jaws may have a high coefficient of friction in the region of their clamping surfaces.

25 Claims, 7 Drawing Sheets

U.S. PATENT DOCUMENTS

| | | | |
|---|---|---|---|
| 5,343,686 | A | 9/1994 | Buchner et al. |
| 5,404,619 | A | 4/1995 | Jorg |
| 5,457,851 | A | 10/1995 | Mondini |
| 5,502,875 | A | 4/1996 | Stolz et al. |
| 5,796,220 | A | 8/1998 | Clapp et al. |
| 6,163,931 | A | 12/2000 | Leifeld |
| 6,173,478 | B1 | 1/2001 | Patelli et al. |
| 6,216,318 | B1 | 4/2001 | Leifeld |
| 6,235,999 | B1 | 5/2001 | Rubenach |
| 6,295,699 | B1 | 10/2001 | Temburg |
| 6,499,194 | B1 | 12/2002 | Gresser et al. |
| 6,611,994 | B2 | 9/2003 | Bischofberger et al. |
| 7,173,207 | B2 | 2/2007 | Losbrock et al. |
| 2002/0124354 | A1 | 9/2002 | Pferdmenges et al. |
| 2003/0005551 | A1 | 1/2003 | Schurenkramer et al. |
| 2003/0029003 | A1 | 2/2003 | Breuer et al. |
| 2003/0070260 | A1 | 4/2003 | Rubenach |
| 2003/0154572 | A1 | 8/2003 | Pferdmenges et al. |
| 2004/0040121 | A1 | 3/2004 | Schmitz |
| 2004/0128799 | A1 | 7/2004 | Hosel et al. |
| 2005/0076476 | A1 | 4/2005 | Temburg |
| 2005/0198783 | A1 | 9/2005 | Rubenach |
| 2005/0278900 | A1 | 12/2005 | Dammig |
| 2006/0260100 | A1 | 11/2006 | Duda et al. |
| 2007/0180658 | A1 | 8/2007 | Saeger et al. |
| 2007/0180659 | A1 | 8/2007 | Saeger et al. |
| 2007/0180660 | A1 | 8/2007 | Saeger et al. |
| 2007/0266528 | A1 | 11/2007 | Farber et al. |
| 2008/0092339 | A1 | 4/2008 | Bossman et al. |
| 2009/0000065 | A1 | 1/2009 | Saeger et al. |
| 2009/0000066 | A1 | 1/2009 | Saeger et al. |
| 2009/0000067 | A1 | 1/2009 | Leder et al. |
| 2009/0000068 | A1 | 1/2009 | Saeger et al. |
| 2009/0000069 | A1* | 1/2009 | Saeger et al. ..... 19/115 R |
| 2009/0000070 | A1 | 1/2009 | Saeger et al. |
| 2009/0000071 | A1 | 1/2009 | Saeger et al. |
| 2009/0000072 | A1 | 1/2009 | Saeger et al. |
| 2009/0000073 | A1 | 1/2009 | Saeger et al. |
| 2009/0000074 | A1 | 1/2009 | Bossmann |
| 2009/0000075 | A1 | 1/2009 | Saeger et al. |
| 2009/0000076 | A1 | 1/2009 | Bossmann et al. |
| 2009/0000077 | A1* | 1/2009 | Saeger et al. ..... 19/233 |
| 2009/0000078 | A1 | 1/2009 | Saeger et al. |
| 2009/0000079 | A1 | 1/2009 | Bossmann |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A1 | 10/2005 |
| WO | WO-2006/012758 | A1 | 2/2006 |

OTHER PUBLICATIONS

German Patent Office Search Report. dated Jul. 10, 2007, Issued in related German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

The present application claims priority from German Utility Model Application Number 202007010686.6 dated Jun. 29, 2007, and German Patent Application Number 102008014174.7 dated Mar. 14, 2008, the entire disclosure of each of which is incorporated herein by reference.

BACKGROUND OF THE INVENTION

The invention relates to an apparatus for the fibre-sorting or selection of a fibre bundle comprising textile fibres, especially for combing. In a known apparatus, fibre sliver is supplied by means of supply device to a fibre-sorting device, especially to a combing device, in which clamping devices are provided, which clamp the fibre bundle at a distance from its free end and a mechanical device is present which generates a combing action from the clamping site to the free end of the fibre sliver in order to loosen and remove non-clamped constituents, such as, for example, short fibres, neps, dust and the like from the free end. For removal of the combed fibre material at least one take-off device is present. The clamping devices each comprise two nipper arms with clamping jaws (upper and lower nipper).

In practice, combing machines are used to free cotton fibres or woollen fibres of natural impurities contained therein and to parallelise the fibres of the fibre bundle. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards.

In order to separate short fibres, neps, dirt and other constituents from a fibre mixture it is known to supply the fibre material in the form of lap rolls to combing machines for mechanical combing-out, the end of the lap web being clamped by a nipper and the end projecting beyond the clamping line, the fibre tuft being mechanically combed-out by means of the comb clothing of a circular comb. The combed-out fibre bundle is then transferred to a detaching roller pair where it is in turn formed into a coherent web, or "pieced". When the fibre bundle is removed from the nipper by the detaching rollers, the end severed from the lap is likewise pulled through a mechanical top comb, so that as far as possible no short fibres, neps, dirt and other undesirable constituents remain in the combed web. A disadvantage of that known combing method is, in particular, the discontinuous mode of operation, in which large masses have to be accelerated and decelerated during the operating cycle.

The back and forth swinging movement of the nipper assembly gives rise to very substantial vibration, especially in the case of high nip rates, which on the one hand requires the drive elements and bearing elements to be of suitably stable construction and on the other hand places high demands on the framework of the machine as well as on the base on which the machine is mounted.

In order to be able to remove the partially cleaned fibres from the jaws of the nipper unit using the rollers of the take-off device, either the relatively heavy take-off device needs to move linearly or over part of an arc of a circle to the fibre bundle held between the jaws of the nipper arrangement or, the other way round, the nipper arrangement has to be moved towards the stationary take-off rollers. In the case of the 450 nips per minute usually required, the large masses being moved result in a high level of dynamic agitation of the entire combing machine which limits its operating speed and productivity.

Furthermore, a problem of conventional combing machines is that when the combed fibres are removed by the counter-rotating take-off rollers, up to 50% of the fibre length has not been cleaned by the circular comb, because during the combing process, that is to say when the combing segment passes, the fibres were clamped between the jaws of the nipper arrangement or were located behind the jaws, seen in the transport direction. In order also to clean that portion of the fibres as well as possible, those fibres are conventionally pulled through a top comb arranged in front of the take-off rollers. The top comb is an additional structural element for every combing head.

The detaching roller pair, consisting of a lower detaching roller and an upper detaching roller, is directly adjacent to the nipper apparatus and the circular comb. The lower detaching roller is located between the path of movement of the comb tips of the circular comb and the upper detaching roller and, together with the upper detaching roller, forms the clamping nip for the combed bundles. The nipper arrangement is mounted so as to swing in two directions. Firstly, it is moved, at a distance from the detaching roller pair, towards the path of movement of the comb tips of the circular comb. In that position, the combing of the fibre bundle is carried out by the circular comb. When that operation is complete, the nipper apparatus is raised as a unit so that the fibre bundle that has just been combed arrives in front of the clamping nip of the detaching roller pair. During that movement, the nipper apparatus also approaches the detaching roller nip horizontally. The portion of combed sliver conveyed back at that time point is overlapped with the tips of the new, combed fibre bundle, compressed in the clamping nip of the detaching rollers and drawn in the take-off direction by the detaching rollers, the top comb being inserted into the end of the fibre bundle that has just been combed and combing out that free piece of fibre. As a result of the receding movement of the nipper apparatus and the take-off movement of the detaching roller pair, the combed fibre bundle is detached and a fresh fibre bundle is supplied to the nipper apparatus by the feed roller, clamped and brought into the combing position relative to the circular comb. Such an arrangement is disadvantageous because, in particular, the nipper apparatus has to perform a variety of very large movements with greater or lesser degrees of acceleration. The operating speed is thus considerably limited, a large amount of noise is generated and the inertial forces that arise result in above-average wear. Adjustment of the detaching distance and the feed quantity can be effected only while the machine is stationary. A further crucial disadvantage is that the free end of the fibre bundle that has just been combed also has to be moved at relatively high speed, with its free fibre tips to the front, over large distances and placed in an exactly defined position onto the returned end of the combed sliver. In dependence upon the air vortices that occur and the respective air resistance, the fibre bundle is frequently incorrectly positioned on the returned combed sliver so that it is necessary to operate at relatively low speeds. In any case, however, losses of quality are observed in the combed sliver.

A further disadvantage of the known apparatus is that uncontrolled fold-formation occurs between the detaching roller pair and the take-off rollers as a result of the pilgrim-step motion of the detaching rollers, which additionally results in disruption of the combing process.

When the nipper is located in its forward position, it is opened and transfers the combed-out fibre bundle to the detaching roller pair that bundle being pieced with the previously detached fibre bundle.

The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The nipper assembly comprises a lower nipper, which co-operates with an upper nipper plate. The upper nipper plate is here pivotally mounted on the lower nipper by way of a pivot axis. The lower nipper and the upper nipper are formed with complementary profiles at their front end region, via which, when the nipper assembly is closed, they clamp the lap supplied via a feed cylinder. The fibre tuft protruding in this clamped position from the nipper assembly is combed by a comb segment of a circular comb. The circular comb arranged beneath the nipper assembly is secured, without relative rotation, on a circular comb shaft, which is connected via the drive connection to a gear mechanism. The drive of the gear mechanism is effected by a main motor. The nipper assembly is pivotally mounted on the axis of the circular comb shaft via one (or two) pivot arm(s). The free end of the pivot arm is fixedly secured to the frame of the lower nipper. In its rear region, the lower nipper has a pivot axis, on which a lever is rotatably mounted. This lever is rotatably secured via an axle to a crank disc. The axle of the crank disc is in connection via a drive connection with a drive motor. The nipper parts are steel plates with a contour worked therein for clamping the fibre lap. The nipper parts are secured to the nipper assembly oscillating back and forth. The clamping force of about 300N is generated by an eccentric shaft with compression spring. Its function is to clamp the lap during combing, and to align it in a downward direction towards the circular comb roller. During the detaching operation, the nipper is open. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having: a fibre-sorting device in which clamping devices are provided which each clamp a bundle of the textile fibres at a distance from its free end; a supply device for supplying the fibre bundle to the fibre-sorting device; and at least one mechanical device for generating a combing action from the clamping site to the free end of the fibre bundle in order to loosen and remove non-clamped constituents; and, a take off device; wherein the fibre-sorting device comprises at least two rotatably mounted rollers that, in use, rotate rapidly without interruption, the clamping devices for the fibre bundles being distributed spaced apart in the region of the periphery of said rollers and each comprising two nipper arms with clamping jaws, the clamping jaws including clamping surfaces, wherein at least one nipper part of each clamping device is at least partially resilient.

By implementing the functions of clamping and moving the fibre bundles to be combed-out on at least two rotating rollers, high operating speeds (nip rates) are achievable—unlike the known apparatus—without large mass accelerations and reversing movements. In particular, the mode of operation is continuous. When two high-speed rollers are used, a very substantial increase in hourly production rate (productivity) is achievable which had previously not been considered possible in technical circles. A further advantage is that the rotary rotational movement of the rollers with the plurality of clamping devices leads to an unusually rapid supply of a plurality of fibre bundles per unit of time to the first roller and to the second roller. In particular the high rotational speed of the rollers allows production to be substantially increased.

To form the fibre bundle, the fibre sliver pushed forward by the feed roller is clamped at one end by a clamping device, and is detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is delivered from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

The fibre bundles are—unlike the known apparatus—held by a plurality of clamping devices and transported under rotation. The clamping point at the particular clamping devices therefore remains constant until the fibre bundles are transferred to the first or second rollers. A relative movement between clamping device and fibre bundle does not begin until after the fibre bundle has been gripped by the first or second roller respectively and in addition clamping has been terminated. Because a plurality of clamping devices are available for the fibre bundles, in an especially advantageous manner fibre bundles can be supplied to the first or second roller respectively one after the other and in quick succession, without undesirable time delays resulting from just a single supply device. A particular advantage is that the supplied fibre bundles on the first roller (which is, preferably, a turning rotor) are continuously transported. The speed of the fibre bundle and of the co-operating clamping elements is the same. The clamping elements close and open during the movement in the direction of the transported fibre material. The at least one second roller (which is, preferably, a combing rotor) is arranged downstream of the at least one first roller (turning rotor). With the apparatus according to the invention, a substantially increased productivity is achievable. A further particular advantage is that at high and maximum operating speeds of the rotor combing machine, at least one nipper part is lightweight, resilient, resistant to reversed bending stress, and flat, and at the same time allows reliable clamping of the fibre material. Because of the high coefficient of friction of the clamping surfaces with respect to the fibre material, a large frictional resistance is achieved, which is important especially when detaching the fibre material from the supply means.

In certain preferred embodiments at least one nipper of each clamping device is at least partially in the form of a flexible spring. The flexible spring may be a leaf spring. A metallic leaf spring may be used. The leaf spring may comprise plastics material. The leaf spring may comprise fibre-reinforced plastics material. The leaf spring may comprise glass fibre-reinforced plastics material (GRP). The leaf spring may comprise carbon fibre-reinforced plastics material (CFRP). Where as is preferred, the clamping jaws have a high coefficient of friction in the region of their clamping surfaces, the high coefficient of friction may be determined by the material in the region of the clamping surface. The material may be a plastics material having a high coefficient of friction. The material may be rubber or the like having a high coefficient of friction.

The high coefficient of friction may be determined by a mechanical surface property in the region of the clamping surface. The clamping surfaces may be roughened or the like. The clamping surfaces may be profiled or the like. The clamping surfaces may be corrugated or the like.

In certain preferred embodiments of the invention, there is provided apparatus with a nipper assembly for a rotor combing machine as described above, wherein least one nipper part is in the form of a leaf spring and in the region of the clamping point is provided with contours improving clamping and/or with elements improving the friction pairing between fibres and clamping jaws. The clamping nippers may be mounted on a rotatably mounted high-speed roller. The clamping forces may be determined by the thickness and/or form of the leaf spring. Plastics material elements or rubber elements, for example, may be used to improve the friction pairing. The plastics material elements or rubber elements may be usable for cushioning the nipper closing action. The nipper parts may be manufactured from steel, aluminium, plastics material, GRP or CFRP. The movable nipper elements may be made from lightweight material.

In some embodiments, the drive of the nippers may be effected mechanically, for example, via cam mechanisms. In other embodiments, the drive of the nippers may be effected electromagnetically or pneumatically, for example, via electromagnets. A non-yielding or resiliently yielding counter-layer may be arranged on one nipper element, for example, on the lower nipper. The movable nipper element may be demountable with no need to demount the nipper shaft. The movement of at least one clamping nipper may be effected through intrinsic resilience.

The invention further provides apparatus for the fibre-sorting or fibre-selection of a fibre bundle comprising textile fibres, especially for combing, which is supplied by means of supply means to a fibre-sorting device, especially a combing device, in which clamping devices are provided which clamp the fibre bundle at a distance from its free end, and mechanical means are present which generate a combing action from the clamping site to the free end of the fibre bundle, in order to loosen and remove non-clamped constituents, such as, for example, short fibres, neps, dust and the like from the free end, wherein for removal of the combed fibre material at least one take-off means is present and the clamping devices each comprise two nipper arms with clamping jaws (upper and lower nipper), characterised in that downstream of the supply means there are arranged at least two rotatably mounted rollers rotating rapidly without interruption, which are provided with clamping devices for the fibre bundle, which clamping devices are distributed spaced apart in the region of the periphery of the rollers, at least one nipper part of each clamping device is at least partially resilient and the clamping jaws have a high coefficient of friction in the region of their clamping surfaces.

DETAILED DESCRIPTION OF CERTAIN PREFERRED EMBODIMENTS

Figure 1:
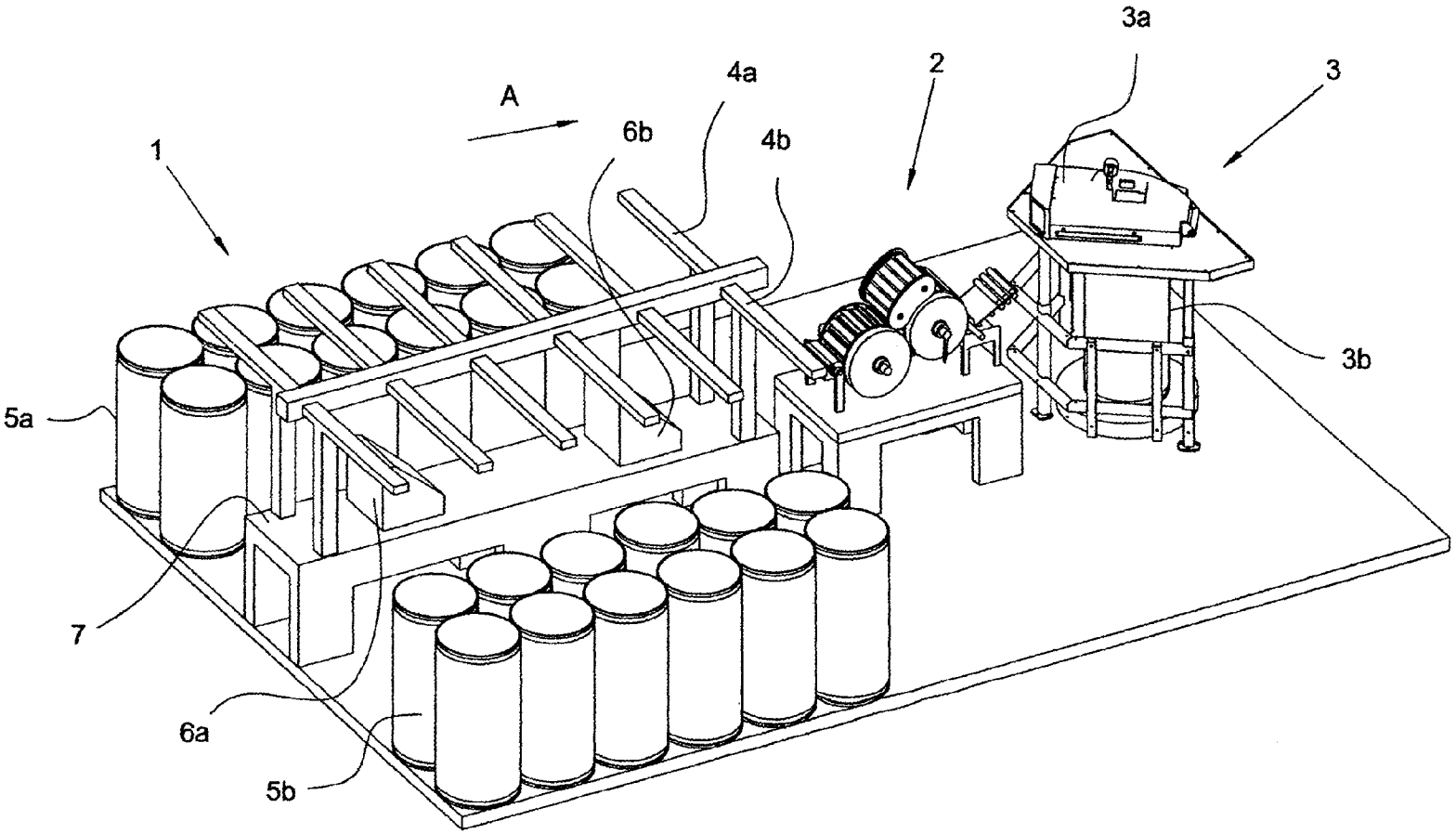
FIG. 1 is a diagrammatic perspective view of a device for combing fibre material, comprising a combing preparation device, a rotor combing machine and a fibre sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further construction, more than one rotor combing machine 2 is provided. If, for example, two rotor combing machines 2*a* and 2*b* are present, then the two delivered comber slivers 17 can pass together through the downstream autoleveller drafting system 50 and be deposited as one drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

Figure 2:
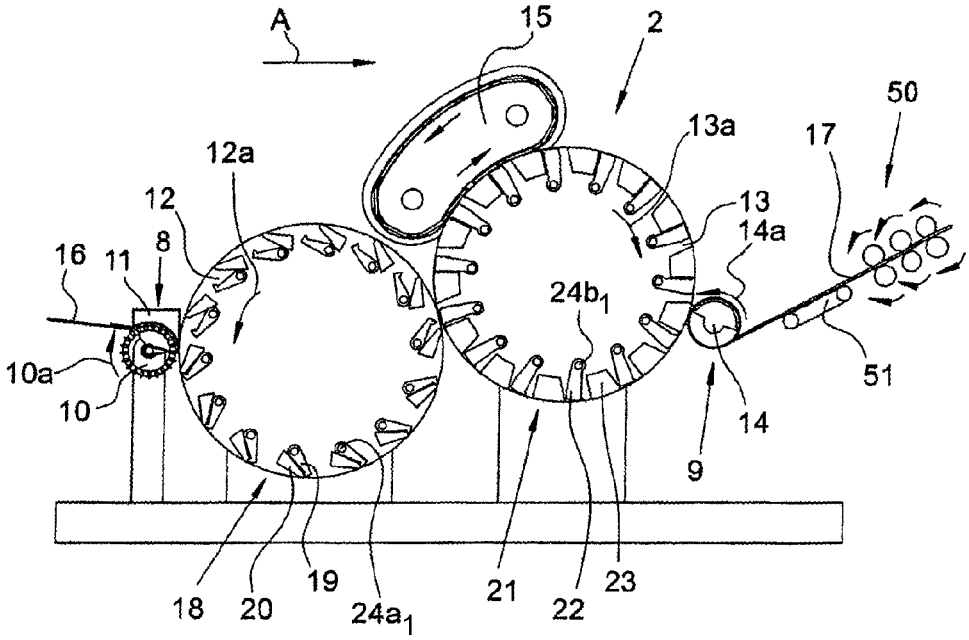
FIG. 2 is a diagrammatic side view of a rotor combing machine according to the invention having two rollers.

FIG. 2 shows a rotor combing machine 2 having a supply device 8 comprising a feed roller 10 and a feed trough 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle (not shown) (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing $\mathbf{24}b_1$, which is attached to the roller 13. The free end of the upper nipper 22 faces the periphery of the roller 13. The upper nipper 22 and the lower nipper 23 co-operate so that they are able to grip a fibre bundle (not shown) (clamping) and release it. In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. The reference numeral 51 denotes a driven ascending conveyor, for example, a conveyor belt. An upwardly inclined metal plate or the like may also be used for conveying purposes.

Figure 3:
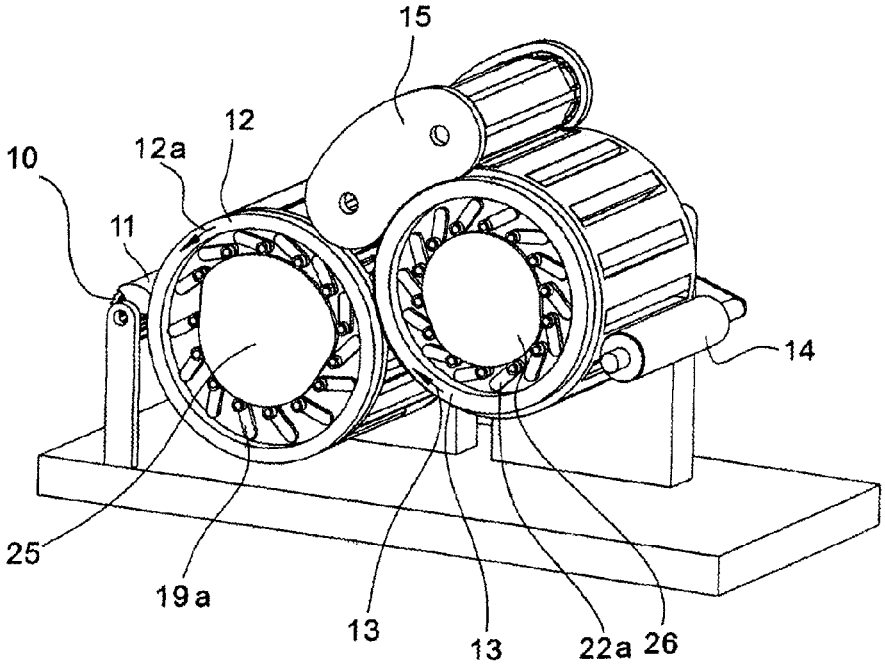
FIG. 3 is a perspective view of a rotor combing machine generally according to FIG. 2 having two cam discs.

In the embodiment of FIG. 3, two fixed cam discs 25 and 26 are provided, about which the roller 12 having the first clamping devices 18 and the roller 13 having the second clamping device 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26 respectively, the upper nippers 19 and 22 are rotated about pivot axes $\mathbf{24}a_1$ and $\mathbf{24}b_1$, respectively. In that way, the opening and closing of the first clamping devices 18 and the second clamping devices 21 is implemented. The reference numerals 19*a* and 22*a* denote roller levers.

Figure 4A:
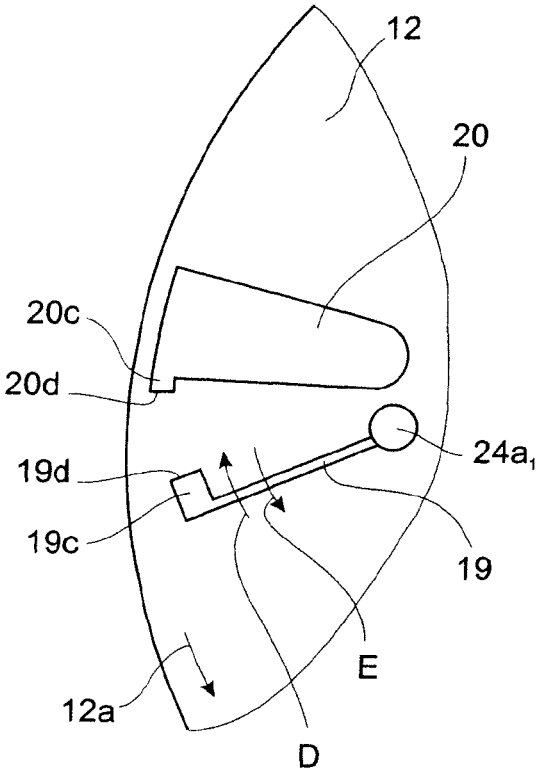
FIG. 4*a*, 4*b* is a diagrammatic side view of a clamping device with two clamping nippers (upper and lower nipper), the upper nipper in the form of a leaf spring being disengaged from the lower nipper (FIG. 4*a*) and being in engaged with the lower nipper (FIG. 4*b*)
Figure 4B:
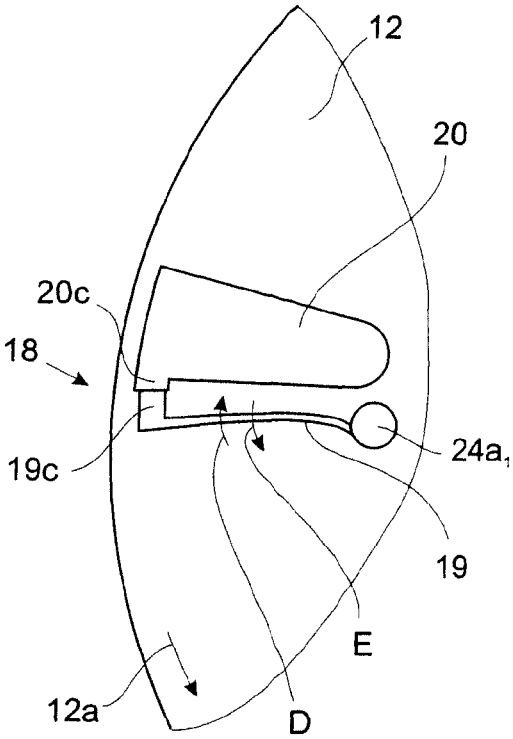

In the embodiment of FIGS. 4*a* and 4*b*, a clamping device 18 (nipper assembly) consists of two clamping nippers (upper nipper 19, lower nipper 20), one clamping nipper (upper nipper 19) being rotatable in the direction of arrows D, E. In its one end region, the upper nipper 19 is mounted on a pivot joint 24*a*, which is mounted on the roller 12. The upper nipper 19 is movable in relation to the lower nipper 20 and is in the form of a leaf spring. In FIG. 4*a*, the clamping jaw of the upper nipper 19, i.e. the end region of the upper nipper 19 remote from the pivot bearing 24*a*, is disengaged from the lower nipper. In FIG. 4*b*, in consequence of a force effect (not illustrated) the upper nipper 19 is resiliently deflected in direction D, with the result that the clamping point 19*d* of the clamping jaw 19*c* of the upper nipper 19 is engaged with the clamping point 20*d* of the clamping jaw 20*c* of the lower nipper 20.

The upper nipper 19 consists of a fibre-reinforced composite material, for example, glass fibre-reinforced plastics material, which is lightweight (e.g. 1.8 g/cm$^3$). The lightweight material may lie in the range of 0.5 g/cm$^3$ to 5 g/cm$^3$. The lightweight material may lie in the range of 1 g/cm$^3$ to 3 g/cm$^3$, or, more preferably, 1 g/cm$^3$ to 2 g/cm$^3$. Owing to the substantially reduced mass inertia, a high nip rate (closing sequence) with rapid resilient deflection for applying the clamping force and rapid spring-back is advantageously achieved. The leaf spring is lightweight, resilient, resistant to reversed bending stress, and flat.

In the further embodiments described below, the nipper pairs which may differ in their structure and operation from those described with reference to FIGS. 4*a* and 4*b*, may be made of any suitable lightweight materials including those mentioned with reference to the nipper pairs of FIGS. 4*a* and 4*b*.

Figure 5:
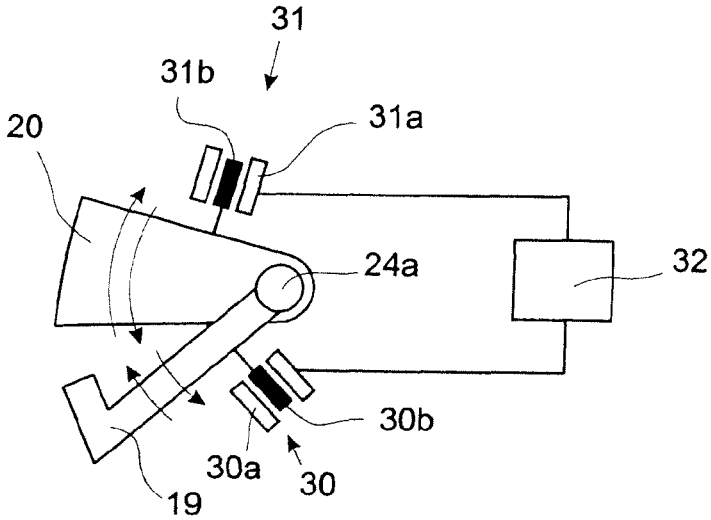
FIG. 5 shows a clamping device, in which the two clamping nippers are each assigned a separate (their own) electromagnetic drive device, which is connected to a common control and regulation device.

In the embodiment of FIG. 5, an electromagnetic operating device 30 (lifting magnet) is associated with the upper nipper 19 and an electromagnetic operating device 31 (lifting magnet) is associated with the lower nipper 20. Each electromagnetic operating device 30, 31 consists of what is known as an actuator housing (not shown), within which two electromagnetic coils 30*a* and 31*a* are arranged; a respective armature plate 30*b*, 31*b* is guided with longitudinal displacement between them. This armature plate is moved by the correspondingly energized electromagnetic coils, and transfers its movement directly to the associated upper nipper 19 respectively lower nipper 20. The electromagnetic operating devices 30, 31 are connected to a common electrical control and regulation device 32. The movement of the upper nipper 19 and of the lower nipper 20 in relation to one another is thereby individually and variably controllable. The upper and lower nippers are separately driven by the electromagnetic operating devices 30, 31. The upper nipper and lower nipper may be of lightweight material.

Figure 6:
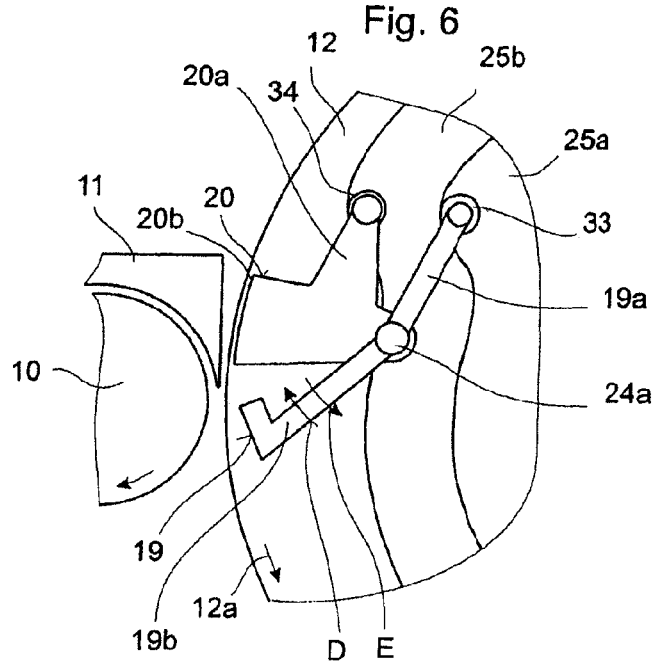
FIG. 6 is a diagrammatic side view of a clamping device, in which the two movable clamping nippers are each assigned a separate (their own) mechanical drive device in the form of two different cam discs, permitting a separate or independent drive of the clamping nippers.

In the embodiment of FIG. 6, the upper nipper 19 and the lower nipper 20 are rotatably mounted at a common pivot joint 24*a*. The upper nipper 19 is in the form of a two-armed lever, one lever arm forming a roller lever 19*a* and the other lever arm 19*b* performing the clamping function. A rotatable roller 33 (cam follower roller) is arranged at the end region of the roller lever 19*a* remote from the pivot bearing 24*a*. The lower nipper 20 is in the form of an angled lever, one lever arm forming a roller lever 20*a* and the other lever arm 20*b* performing the clamping functions. A rotatable roller 34 (cam follower roller) is arranged at the end region of the roller lever 20*a* remote from the pivot bearing 24*a*. The drive of the upper nipper 19 and the lower nipper 20 is effected mechanically via cam mechanisms. The force of resilient loading elements (not shown), for example, springs, acting on the roller levers 19*a* and 20*a* respectively presses the rollers 33 and 34 against two stationary cam discs 25*a* and 25*b* respectively. Owing to the different construction of the roller levers 19*a*, 20*a* and the cam discs 25*a*, 25*b*, a different movement of the upper nipper 19 and the lower nipper 20 is implemented. A separate yet independent movement of the nippers 19, 20 is thereby rendered possible.

Figure 7:
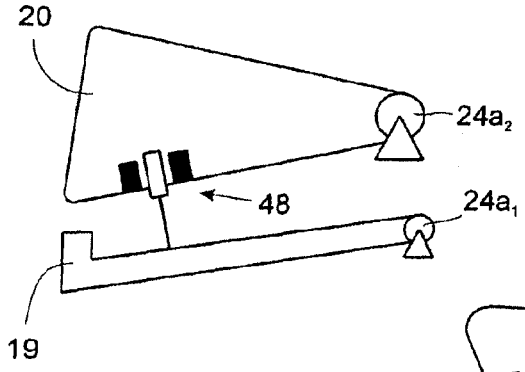
FIG. 7 shows the nipper drive by means of an electromagnet assigned to the upper nipper.

In the embodiment of FIG. 7, a nipper drive of the upper nipper 19 by an electromagnet 48 is provided, in which the electromagnetic coil is secured to the lower nipper 20 and the armature plate is secured to the upper nipper 19. The lower nipper 20 pivots about a pivot bearing 24$a_2$.

Figure 8:
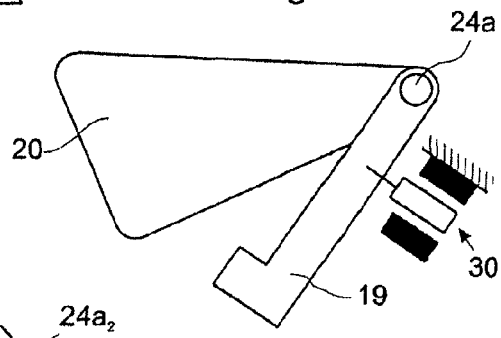
FIG. 8 shows the nipper drive by means of an electromagnet between the clamping nippers (lower and upper nipper)

In the case of the embodiment according to FIG. 8—unlike the construction shown in FIG. 5—a lifting magnet is assigned only to the upper nipper 19. The lower nipper 20 can be driven in a different manner (not shown), for example, mechanically by a cam disc.

Figure 9:
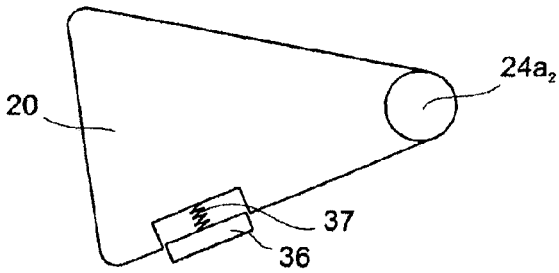
FIG. 9 shows a spring-loaded counter-layer on a clamping nipper, for example, lower nipper.

In an embodiment shown in FIG. 9, a counter-element 36 for the clamping jaw of the upper nipper 19 (not shown) is arranged on the lower nipper 20, the counter-element being resiliently loaded by a spring 37.

Figure 10A:
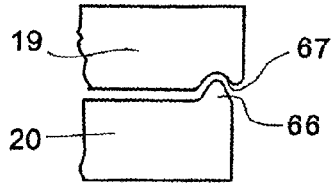
FIG. 10*a* to 10*g* are diagrammatic views of different clamping contours on the clamping jaws.
Figure 10B:
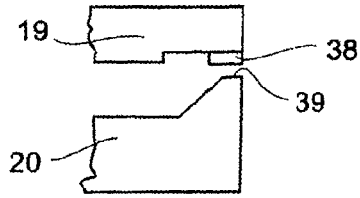
Figure 10C:
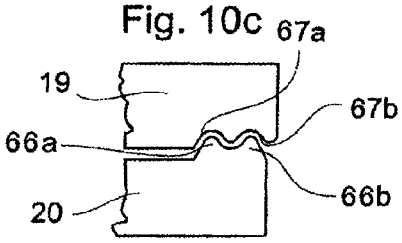
Figure 10D:
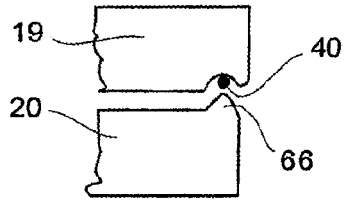
Figure 10E:
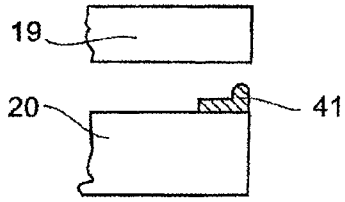
Figure 10F:
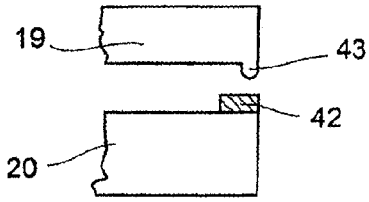
Figure 10G:
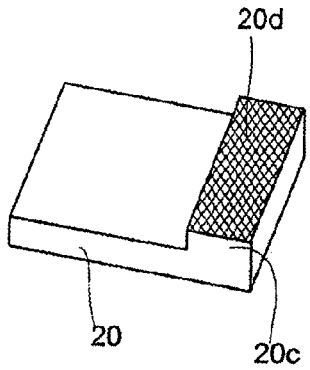

FIGS. 10*a* to 10*f* show different clamping contours or profiles of the clamping jaws in the end region of the clamping nippers 19 and 20. The clamping jaws can be made in one piece (FIG. 10*a*, 10*c*) or in two pieces (FIG. 10*b*, 10*e*, 10*f*). By means of the profiles of the clamping jaws, when the clamping device (nipper assembly) is closed the upper nipper 19 and the lower nipper 20 clamp the fibre material. According FIG. 10*a*, a rounded projection 66 on the lower nipper 20 and a rounded depression 67 on the upper nipper 19 engage with one another; according to FIG. 10*c*, two projections 66*a*, 66*b* engage in two depressions 67*a*, 67*b*. According to FIG. 10*b*, on the clamping jaw of the upper nipper 19 there is disposed a flat strip or plate 38, which co-operates with a flat surface 39 on the clamping jaw of the lower nipper 20. FIG. 10*d* corresponds substantially to FIG. 10*a*, a resilient element 40, for example, a rubber element or the like, being arranged in the depression 67. According to FIG. 10*e*, on the clamping region of the clamping jaw of the lower nipper 20 there is arranged a resilient element 41, for example, of rubber or the like, which has a rounded projection in the direction towards the clamping surfaces on the clamping jaw of the upper nipper 19. According to FIG. 10*f*, on the clamping region of the clamping jaw of the lower nipper 20 there is mounted a resilient element 42, for example, of rubber, an elastomer polyurethane e.g. Vulkollan™, silicone or the like, which co-operates with a nose-like projection 43 on the clamping jaw of the upper nipper 19. According to FIG. 10*g*, the clamping surface 20*d* of the clamping jaw 20*c* has a slight surface texture, for example, through corrugation, roughening or the like, to increase the coefficient of friction. Similarly, all clamping surfaces can have a texture to increase grip with respect to the fibre material.

Figure 11:
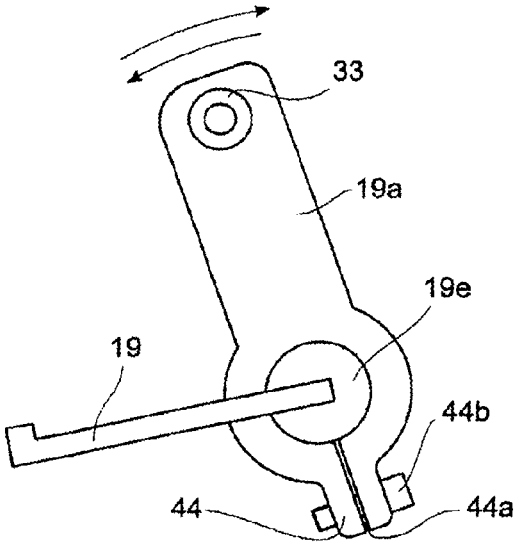
FIG. 11 shows an adjustable roller lever.

FIG. 11 shows an adjustment mechanism for a nipper. One end region of the upper nipper 19 is rigidly connected to the roller lever 19*a*. The roller lever 19*a* has a two-part extension 44 with a continuous slot 44*a*, which is closable to a greater or lesser extent by a screw 44*b*. A cylindrical adjustment attachment 19*e* on the upper nipper 19 can thus be turned in a cylindrical bore of the roller lever 19*a* and consequently the angle between the roller lever 19*a* and the upper nipper 19 can be altered, so that the relative movement between upper nipper 19 and lower nipper 20 is adjustable.

Figure 12:
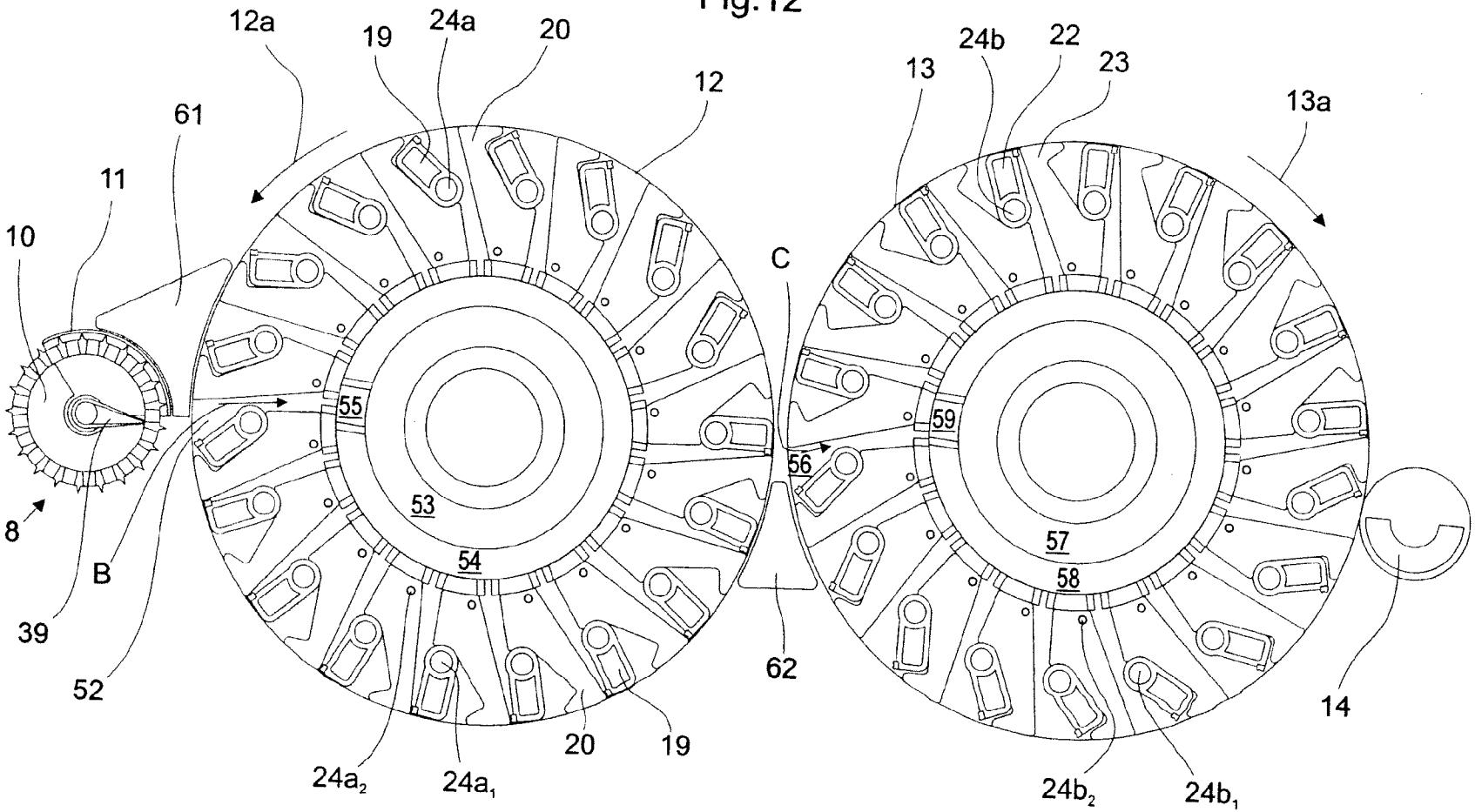
FIG. 12 shows a rotor combing machine as in FIG. 2, with reduced pressure channels and suction openings assigned to each of the clamping devices of the first and second rollers, and a blown air nozzle inside the supply roller.

In the embodiment of FIG. 12, the rotatably mounted rollers 12 and 13 with clamping devices 19, 20 and 22, 23 respectively are additionally fitted with suction channels 52 and 56 respectively (suction openings) which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow at the suction openings 52, 56. The reduced pressure can be generated by connecting to a flow-generating machine. The suction flow at the individual suction openings 52, 56 can be so switched between reduced pressure region and suction opening that it is applied only at particular selected angular positions on the roller circumference. For the purpose of the switching, valves or a valve pipe 54, 58 with openings 55 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a flow of blown air B, C can be provided in the region of the supply device 8 and/or in the region of transfer between the rollers. The source of the flow of blown air (blowing nozzle 39) is arranged inside the feed roller 10 and acts, through the air-permeable surface of the supply device or through air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the rotor perimeter of the first roller 12, directly under or over each nipper device. For the blown air generation there may be used compressed air nozzles or air blades.

The suction flow B is able not only to promote the deflection but also the process of separating the lap and the fibre tuft to be detached in the region of the supply device 8, and to shorten the time required for this.

As a result of the provision of additional air guide elements and lateral screens 61, 62 the direction of the flow can be influenced and the air carried round with the rotors separated off. In that way the time for alignment can be further shortened. In particular, a screen element between the first rotor 12 and supply device 8 over the lap and a screen element on each side of the roller have proved useful.

The combed-out fibre portion passes from the second roller 13 onto the piecing roller 14.

Figure 13:
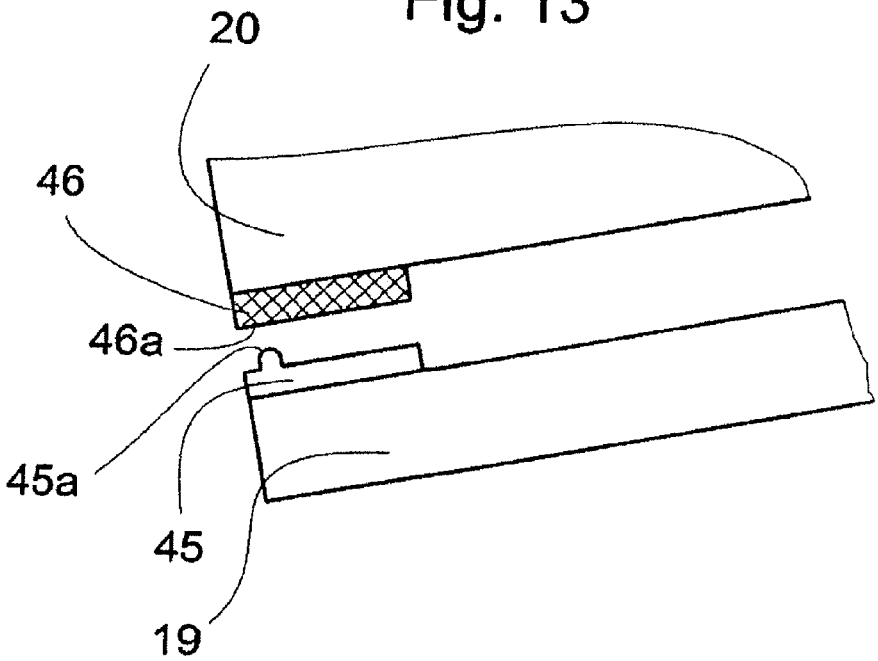
FIG. 13 shows clamping elements on the clamping jaws.

In the embodiment of FIG. 13, plastics material elements or rubber elements 45 and 46 respectively (clamping elements) are inset on the clamping jaws of the upper nipper 19 and the lower nipper 20 to improve the friction pairing. The clamping surfaces 45*a* and 46*a* of the plastics material elements or rubber elements 45 and 46 have a high coefficient of friction. The coefficient of friction, for example, between rubber/fibre material is e.g. >0.5 to 0.6 compared with 0.3 of steel/fibre material. The coefficient of friction may be, for example, from 0.4 to 0.8.

Figure 14:
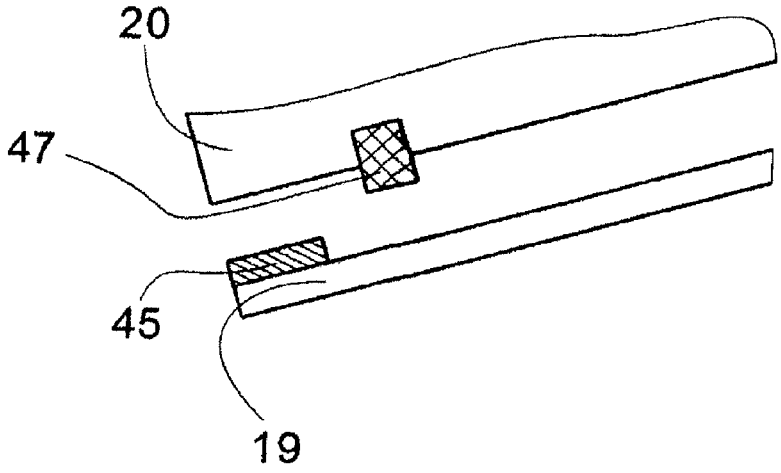
FIG. 14 shows cushioning elements on the clamping jaws.

In the embodiment of FIG. 14, a rubber or plastics material element 47 (cushioning element) to cushion the nipper closing action is mounted on the lower nipper 20. The plastics material elements or rubber elements 45 and 46 (FIGS. 13 and 14) may also be used as cushioning elements.

The apparatus of the invention may additionally or instead provide inter alia one or more of the following advantages:

- Lower nipper and upper nipper are mounted on a rotatably mounted rotor (FIG. 2, 4*a*, 4*b*, 6, 12).
- Lower nipper and upper nipper may be manufactured from steel, aluminium, plastics material, GRP or CFRP.
- In particular the moving nipper elements may be made from lightweight materials.
- The nipper plate, for example, of the upper nipper, may be designed as a leaf spring (FIG. 4*a*, 4*b*).
- The drive of the lower nipper and of the upper nipper may be effected mechanically for example, via cam mechanisms (FIG. 3, 6).
- The drive of the nippers may be effected electromagnetically or pneumatically, for example, via electromagnets (FIG. 5, 7, 8).
- A non-yielding or resiliently yielding counter-layer may additionally be arranged on, for example, the lower nipper (FIG. 9).
- The clamping points may be provided with specific contours improving clamping (FIG. 10*a* to 10*f*).
- Plastics material elements or rubber elements may be placed on the upper nipper and/or the lower nipper or counter-layer to improve the friction pairing (FIG. 10*e*, 10*f*, 13).
- The plastics material elements or rubber elements may additionally be used for cushioning the nipper closing action (FIG. 10*d*, 10*e*, 10*f*, 13, 14).
- The nipper plate may be easy to demount, with no need to demount the nipper shaft.
- The relative movement between lower nipper and upper nipper with respect to one another may be adjusted or adapted, for example, by displacing the roller levers or the cam discs (FIG. 11).

The invention has been explained using the example in particular of the clamping devices 18 on the roller 12 (turning rotor). Similarly, the invention is applicable to the clamping devices 21 on the roller 13 (combing rotor).

The circumferential speeds are, for example, for the feed roller 10 about from 0.2 to 1.0 m/sec; the first roller 12 about from 2.0 to 6.0 m/sec; the second roller 13 about from 2.0 to 6.0 m/sec; the doffer 14 about from 0.4 to 1.5 m/sec; and the revolving card top assembly 15 about from 1.5 to 4.5 m/sec. The diameter of the first roller 12 and the second roller 13 is, for example, about from 0.3 m to 0.8 m.

Using the rotor combing machine 2 according to the invention, more than 2000 nips/min, for example from 3000 to 5000 nips/min, are achieved.

In use of the rotor combing machine according to the invention there is achieved a mechanical combing of the fibre material to be combed, that is, mechanical means are used for the combing. There is no pneumatic combing of the fibre material to be combed, that is, no air currents, e.g. suction and/or blown air currents, are used.

In the rotor combing machine according to the invention there are present rollers that rotate rapidly without interruption and that have clamping devices. Rollers that rotate with interruptions, stepwise or alternating between a stationary and rotating state are not used.

Although the foregoing invention has been described in detail by way of illustration and example for purposes of understanding, it will be obvious that changes and modifications may be practiced within the scope of the appended claims.

What we claim is:

1. An apparatus for the fibre-sorting or fibre-selection of a fibre bundle comprising textile fibres, the apparatus comprising:

a fibre-sorting device comprising a first roller and a roller that rotate rapidly without interruption during use;

clamping devices distributed about the periphery of the first roller and the second roller, each clamping device adapted to clamp a bundle of the textile fibres at a clamping site located at a distance from a free end of the fibre bundle;

a supply device adapted to supply the fibre bundle to the fibre-sorting device;

at least one mechanical device adapted to generate a combing action from the clamping site to the free end of the fibre bundle in order to loosen and remove non-clamped constituents; and a take off device;

wherein each clamping device comprises first and second nipper arms with clamping jaws including clamping surfaces, wherein at least one of the first and second nipper arms of each clamping device is at least partially resilient.

2. An apparatus according to claim 1, wherein at least one of the first and second nipper arms of each clamping device comprises a flexible spring.

3. An apparatus according to claim 2, wherein the flexible spring is a leaf spring.

4. An apparatus according to claim 3, wherein the leaf spring is metallic.

5. An apparatus according to claim 4, wherein the leaf spring comprises plastics material.

6. An apparatus according to claim 5, wherein the leaf spring comprises fibre-reinforced plastics material.

7. An apparatus according to claim 5, wherein the leaf spring comprises glass fibre-reinforced plastics material.

8. An apparatus according to claim 5, wherein the leaf spring comprises carbon fibre- reinforced plastics material.

9. An apparatus according to claim 1, wherein the clamping surfaces of the clamping jaws have a high coefficient of friction.

10. An apparatus according to claim 9, wherein the clamping surfaces comprise a material having a high coefficient of friction.

11. An apparatus according to claim 1, wherein the clamping surfaces comprise a plastics material having a high coefficient of friction.

12. An apparatus according to claim 1, wherein the clamping surfaces comprise a rubber having a high coefficient of friction.

13. An apparatus according to claim 9, wherein the clamping surfaces have a mechanical surface property that determines a high coefficient of friction.

14. An apparatus according to claim 1, wherein the clamping surfaces are roughened.

15. An apparatus according to claim 1, wherein the clamping surfaces are profiled.

16. An apparatus according to claim 1, wherein the clamping surfaces are corrugated.

17. An apparatus according to claim 1, wherein the clamping surfaces of the first and second nipper arms define a clamping point, and a region of the clamping point is contoured.

18. An apparatus according to claim 2, wherein the flexible leaf spring defines a thickness and/or shape that determines clamping forces between the clamping surfaces of the first and second nipper arms.

19. An apparatus according to claim 1, further comprising plastic elements or rubber elements adapted to improve the friction pairing between the clamping surfaces of the first and second nipper arms.

20. An apparatus according to claim 1, further comprising plastic elements or rubber elements adapted to cushion closing action of the first and second nipper arms.

21. An apparatus according to claim 1, further comprising a resilient counter-layer located on one of the first and second nipper arms.

22. An apparatus according to claim 1, wherein the first and second nipper arms pivot about a nipper shaft, and the first and second nipper arms are adapted to be demountable with no need to demount the nipper shaft.

23. An apparatus according to claim 1, wherein the movement of at least one of the first and second nipper arms is effected through intrinsic resilience.

24. An apparatus according to claim 1, wherein the first roller comprises a turning rotor and the second roller comprises a combing rotor.

25. An apparatus according to claim 24, in which the turning rotor and the combing rotor have opposite directions of rotation.

* * * * *